US006765142B2

(12) United States Patent
Sakurada et al.

(10) Patent No.: US 6,765,142 B2
(45) Date of Patent: Jul. 20, 2004

(54) ELECTRONIC KEYBOARD MUSICAL INSTRUMENT

(75) Inventors: Shinya Sakurada, Hamamatsu (JP); Masaki Kudo, Hamamatsu (JP); Kozo Tokuda, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 27 days.

(21) Appl. No.: 10/342,879

(22) Filed: Jan. 14, 2003

(65) Prior Publication Data

US 2003/0131720 A1 Jul. 17, 2003

(30) Foreign Application Priority Data

Jan. 15, 2002 (JP) ..... 2002-006702

(51) Int. Cl.[7] ..... G10H 1/32

(52) U.S. Cl. ..... 84/719; 84/600; 84/601; 84/720; 84/744; 84/745

(58) Field of Search ..... 84/600–602, 718–720, 84/723, 730, 743–745

(56) References Cited

U.S. PATENT DOCUMENTS 3,943,812 A * 3/1976 Nagai et al. ..... 84/689
4,033,219 A * 7/1977 Deutsch ..... 84/626
4,416,178 A 11/1983 Ishida
6,121,535 A * 9/2000 Muramatsu ..... 84/626
6,365,820 B1 * 4/2002 Kondo et al. ..... 84/658

* cited by examiner

*Primary Examiner*—Marlon T. Fletcher
(74) *Attorney, Agent, or Firm*—Morrison & Foerster LLP

(57) ABSTRACT

There is provided an electronic keyboard musical instrument that gives the performance feeling closer to that given by an acoustic piano and enables techniques of expression closer to those used when playing the acoustic piano. Touch information is generated based on first information output when an ON event of a first (deep) SW of a switch section occurs, and a tone generator section generates a musical tone according to the touch. When an OFF event of a third (shallow) SW of the switch section occurs during key release, the musical tone being generated is progressively damped, and at the same time a musical tone having a predetermined characteristic is generated. The OFF event of the third SW is made equivalent to a damper-leaving position in a key stroke of an acoustic piano keyboard.

12 Claims, 14 Drawing Sheets

FIG. 14A

KEYBUF

| CHNo | KCD | KEY EVENT TYPE | Von(k) | EG RATE |
|---|---|---|---|---|
| 0 | KC1 | 1 | | |
| 1 | KC2 | 0 | | |
| 2 | | | | |
| ⋮ | | | | |
| 15 | | | | |

FIG. 14B

TS&S3BUF

| CHNo | TS(k) | S3(k) |
|---|---|---|
| 0 | 10B | 00B |
| 1 | | |
| ⋮ | ⋮ | ⋮ |
| n | ONE OF 00B, 01B, 10B, 11B IS ENTERED | ONE OF 00B, 11B IS ENTERED |
| ⋮ | ⋮ | ⋮ |
| 15 | | |

FIG. 14C

| CHNo | Ton(k) |
|---|---|
| 0 | |
| 1 | |
| ⋮ | |
| 15 | |

ELECTRONIC KEYBOARD MUSICAL INSTRUMENT

BACKGROUND OF THE INVENTION

1. Field of the Invention

The present invention relates to an electronic keyboard musical instrument that gives performance feeling and expression closer to those given when an acoustic piano is played.

2. Description of the Related Art

Recently, an electronic piano has become fairly closer to an acoustic grand piano in its tone-generating system. However, as far as a manner of tone generation responsive to a key release is concerned, the conventional electronic piano has failed to exhibit a sufficient reality.

To eliminate this inconvenience, the present assignee developed an electronic keyboard musical instrument that employs a double sound source (key-on source and key-off source) system in which musical tones generated by an acoustic grand piano during damping at the time of key release are sampled and used as key-off tones generated by the electronic keyboard musical instrument.

However, in the conventional electronic keyboard musical instrument, no consideration has been give of the idea of controlling a musical tone using a position of a string touching a damper member during key release as a turning point. Therefore, although musical tones generated upon key release show reality, the performance feeling given by the musical instrument is different from that given by an acoustic grand piano.

SUMMARY OF THE INVENTION

It is an object of the invention to provide an electronic keyboard musical instrument that gives performance feeling closer to that given by an acoustic piano (e.g. a grand piano) and enables the technique of expression closer to that used when playing the acoustic piano.

To attain the above object, in a first aspect of the present invention, there is provided an electronic keyboard musical instrument comprising an actuating member, an output member that is actuated by the actuating member to output a plurality of pieces of information according to respective actuating positions of the actuating member, a touch information-generating device that generates touch information based on first information output by the output member when the actuating member is in a vicinity of an actuation-terminating position thereof, a musical tone-generating device that generates a musical tone according to the touch information generated by the touch information-generating device, and a control device responsive to second information output by the output member during returning of the actuating member, the second information being generated on a side closer to an actuation-starting position of the actuating member than a position in which the first information is generated, for providing control such that the musical tone being generated is progressively damped and a musical tone having a predetermined characteristic is generated, wherein the output member outputs the second information when the actuating position of the actuating member is equivalent to a damper-leaving position in a key stroke of an acoustic piano keyboard.

According to the first aspect of the invention, when touch information is generated based on first information output by an output member when an actuating member is in a vicinity of an actuation-terminating position of the actuating member, a musical tone is generated according to the touch information, and in response to second information output by the output member during returning of the actuating member, the second information being generated on a side closer to an actuation-starting position of the actuating member than a position in which the first information is generated, the musical tone being generated is progressively damped, and at the same time a musical tone having a predetermined characteristic is generated. Further, the output member outputs the second information when the actuating position of the actuating member is equivalent to a damper-leaving position in a key stroke of a real piano keyboard. Therefore, it is possible to make closer the performance feeling and techniques of expression to those available from the real piano.

To attain the above object, in a second aspect of the invention, there is provided an electronic keyboard musical instrument comprising an actuating member, an output member that is actuated by the actuating member to output a plurality of pieces of information according to respective actuating positions of the actuating member, a touch information-generating device that generates touch information based on first information output by the output member when the actuating member is in a vicinity of an actuation-terminating position thereof, a musical tone-generating device that generates a musical tone according to the touch information generated by the touch information-generating device, and a storage device responsive to one of pieces of second information output by the output member during actuation in a key-depressing direction, the pieces of second information being generated on a side closer to an actuation-starting position of the actuating member than a position in which the first information is generated, the one of pieces of the second information corresponding to a key position remotest from a non-key-depression position, for assigning a first value defined by a plurality of bits to a marker indicative of the one of pieces of the second information corresponding to the key position remotest from the non-key-depression position, and storing the assigned first value, the storage device being responsive to another one of the pieces of the second information different from the first information being output by the output member when the actuating member is in a vicinity of an actuation-starting position thereof during returning of the actuating member, the other one of pieces of the second information corresponding to a key position closest to the non-key-depression position, for assigning a second value defined by a plurality of bits to a marker indicative of the other one of pieces of the second information corresponding to the key position closest to the non-key-depression position, and storing the assigned second value, and a parameter control device that controls musical tone parameters based on the stored first and second values.

According to the second aspect of the present invention, when touch information is generated based on first information output by an output member when an actuating member is in a vicinity of an actuation-terminating position, a musical tone is generated according to the touch information. In response to one of pieces of second information output by the output member during actuation in a key-depressing direction, the pieces of second information being generated on a side closer to an actuation-starting position of the actuating member than a position in which the first information is generated, the one of pieces of the second information corresponding to a key position remotest from a non-key-depression position, a first value defined by a plurality of bits is assigned to a marker indicative of the one of pieces of the second information corresponding to the key position remotest from the non-key-depression position, and the assigned first value is stored. On the other hand, in response to another one of the pieces of the second information different from the first information being output by the output member when the actuating member is in a vicinity of an actuation-starting position thereof during returning of the actuating member, the other one of pieces of the second information corresponding to a key position closest to the non-key-depression position, a second value defined by a plurality of bits is assigned to a marker indicative of the other one of pieces of the second information corresponding to the key position closest to the non-key-depression position, and the assigned second value is stored. Musical tone parameters are controlled based on the stored first and second values. Therefore, even when an output member for outputting a large number of information items is used, a similar sounding system can be applied irrespective of the number of output information items. Therefore, even when the number of make contacts of each switch or the number of output values of a sensor is increased, the sounding system need not be modified very much. This makes it possible to realize a more advanced sounding system while suppressing the cost of development, i.e. contributes to commonality of systems.

Preferably, the output member has a plurality of contacts, and outputs the information according to respective closing states of the contacts.

Preferably, the output member has three contacts.

Preferably, the output member has four contacts.

Preferably, the electronic keyboard musical instrument further comprises a key-off waveform-generating device that generates key-off waveforms.

More preferably, the electronic keyboard musical instrument further comprises a slicing device that slices a key-off waveform generated by the key-off waveform-generating device.

Further preferably, the parameter control device controls a level to which the slicing device slices the key-off waveform, based on the stored first or second value.

To attain the above object, according to a third aspect of the present invention, there is provided an electronic keyboard musical instrument comprising an actuating member, an output member that is actuated by the actuating member to output information according to an actuating position of the actuating member, a detection device that detects a touch condition of a key in a second half of a depression stroke thereof in a key-depressing direction, out of a whole key-depression and key-release stroke of the key, an assigning device responsive to the touch condition of the key being detected by the detecting device, for assigning a musical tone corresponding to the key which is depressed to a predetermined channel a tone-generating device that generates the musical tone assigned to the predetermined channel, and a control device that controls the assigning device such that when a predetermined position in a first half of the depression stroke shallower than the second half of the depression stroke is crossed by the key in a key-releasing direction without the key, to which the musical tone assigned to the predetermined channel corresponds, being re-depressed, the assignment of the musical tone to the predetermined channel is canceled, and when the key, to which the musical tone assigned to the predetermined channel corresponds, is re-depressed without crossing the predetermined position in the key-releasing direction, and a re-touch condition different from the detected touch condition of the key is detected by the detection device upon the re-depression, the musical tone is assigned to a channel different from the predetermined channel according to the re-touch condition of the key.

According to the third aspect of the present invention, when a predetermined position in a first half of a depression stroke shallower than a second half of the depression stroke is crossed by a key in a key-releasing direction without the key, to which a musical tone assigned to a predetermined channel corresponds, being re-depressed, the assignment of the musical tone to the predetermined channel is canceled, and when the key, to which the musical tone assigned to the predetermined channel corresponds, is re-depressed without crossing the predetermined position in the key-releasing direction, and a re-touch condition different from the detected touch condition of the key is detected by a detection device upon the re-depression, the musical tone is assigned to a channel different from the predetermined channel according to the re-touch condition of the key, that is, until key-off is effected, all the tone-generating channels except for ones used for tone generation are made available. Therefore, it is possible to obtain an musical tone effect as will be produced when a key is repeatedly struck with a damper pedal being continuously stepped on. Further, a musical tone can be produced without completely returning the key to its key-off position, and hence it is possible to play fast a passage of a musical piece to be played fast for performance.

The above and other objects, features, and advantages of the invention will become more apparent from the following detailed description taken in conjunction with the accompanying drawings.

BRIEF DESCRIPTION OF THE DRAWINGS

FIG. 14A is a diagram showing an example of a format of a buffer KEYBUF in a RAM appearing in FIG. 6, allocated for storing tone-generating information and tone-attenuating information for each channel;

FIG. 14B is a diagram showing an example of a format of a buffer TS&S3BUF in the RAM appearing in FIG. 6, allocated for storing a touch state TS(k) and a switch S3 (third SW 3*c*) state S3(*k*);

FIG. 14C is a diagram showing an example of a software counter area in the RAM appearing in FIG. 6, allocated for counting a key-on time for each channel;

DETAILED DESCRIPTION OF THE PREFERRED EMBODIMENTS

The present invention will now be described with reference to the drawings showing a preferred embodiment of the present invention.

Figure 1:
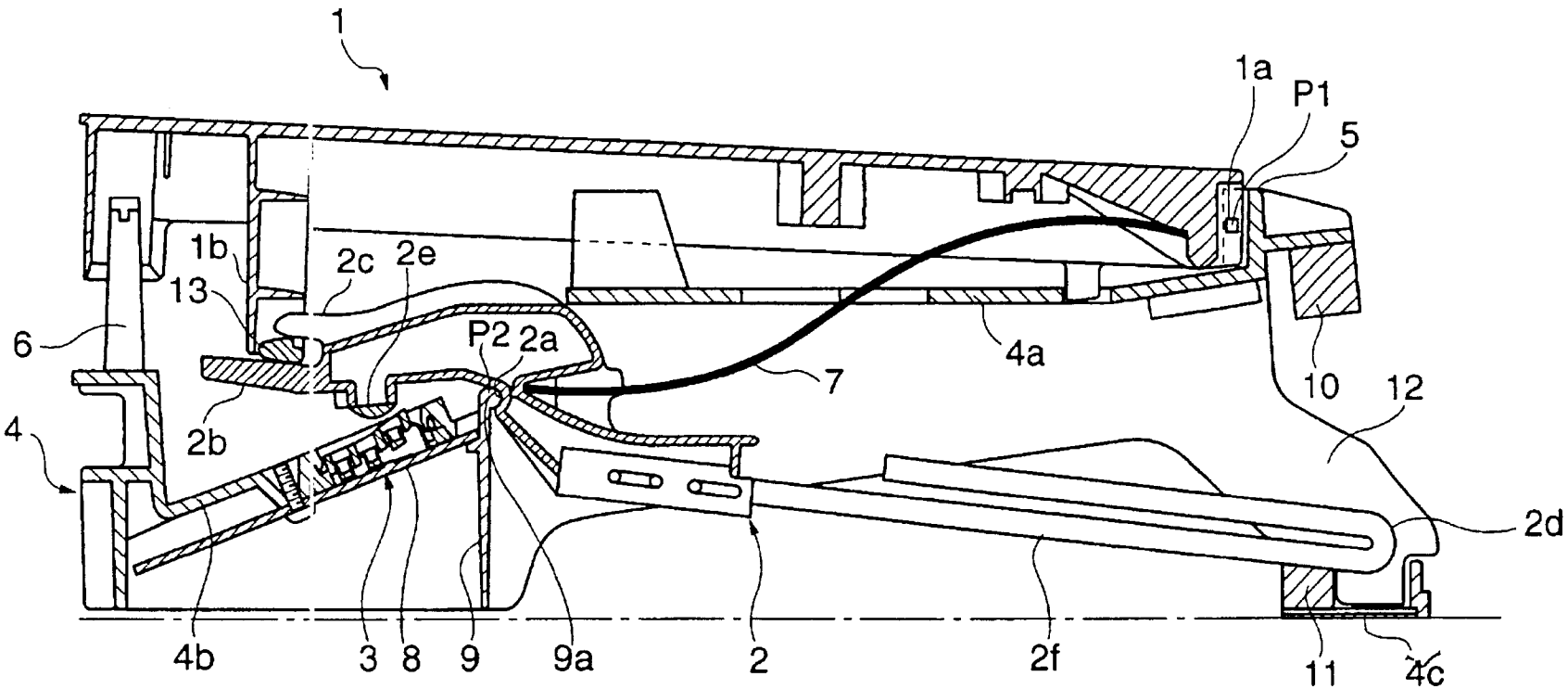
FIG. 1 is a longitudinal cross-sectional view showing the arrangement of an electronic keyboard musical instrument according to an embodiment of the present invention.

FIG. 1 is a longitudinal cross-sectional view of an electronic keyboard musical instrument according to an embodiment of the present invention, which is shown to be in a non-key-depression state (in which a key 1 is at a start position of a key depression stroke).

The electronic keyboard musical instrument according to the present embodiment is mainly comprised of a chassis 4, keys (white keys) 1, and hammers 2 (mass hammer bodies) associated with the respective keys 1, for adding appropriate inertia to key-depressing motions such that the player has a feeling of key depression similar to that experienced when he plays an acoustic piano. It should be noted that black keys are configured similarly to the keys 1, and the both types of keys are pivotally supported on the chassis 4. In the following description, a side of the instrument toward the player will be referred to as a "front" side.

Each key 1 and the hammer 2 associated therewith are arranged such that they can perform vertical pivotal motion about respective axes, i.e. a key pivotal axis P1 and a hammer pivotal axis P2. The key 1 is configured to be capable of actuating the hammer 2 via a cushioning member 13, referred to hereinafter, while the hammer 2 is configured to be capable of actuating a switch section 3.

The key 1 has key fulcrum portions 1*a* extending from lateral sides of a rear end of thereof and each having a convex shape conically curved outward, and the central axis of these key fulcrum portions 1*a* is the key pivotal axis P1. On the other hand, the chassis 4 has a key support portion 5 formed at a rear end of a chassis-horizontal part 4*a*. The key support portion 5 is formed therein with recesses at respective locations opposed to the key fulcrum potions 1*a* of the key 1. The key fulcrum portions 1*a* are engaged with the recesses, respectively, whereby the key 1 is vertically pivotable about the key fulcrum portions 1*a* (key pivotal axis P1).

The key 1 is formed with a hammer-actuating portion 1*b* that extends downward from a front portion of thereof. The hammer-actuating portion 1*b* has the cushioning member 13 made e.g. of an urethane rubber, attached to a lower end thereof. The cushioning member 13 is inserted between an upper extension 2*c* and a lower extension 2*b* of the hammer 2, for transmitting motion of the key 1 when depressed (key-depressing motion) to the hammer 2 and transmitting returning motion of the hammer 2 (key-returning motion) to the key 1. It should be noted that during the key-depressing and key-returning strokes, the cushioning member 13 has its upper end always in contact with the upper extension 2*c* of the hammer 2, thereby ensuring the transmission of the key-depressing and key-returning motions.

In the chassis 4, the chassis-horizontal part 4*a* and a chassis-front part 4*b* thereof are connected together by a rib 12 for reinforcement thereof. From the chassis-front part 4*b*, there extends a key guide 6 for each key 1 so as to restrict pivotal motion of the key in a direction in which the keys are arranged in a row (lateral direction of the key 1).

The hammer 2 is provided for each key 1, and supported via a hammer fulcrum portion 2*a* thereof on a hammer support portion 9*a* (hammer pivotal axis P2) of a support member 9 arranged on the chassis 4 such that a free end 2*d* thereof is vertically pivotable about the hammer support portion 9*a*. Further, a spring 7 having a fork shape is interposed in a suspended manner between a location close to the hammer fulcrum portion 2*a* and a rear portion of the key 1. This spring 7 urges the key 1 against the key support portion 5 and at the same time urges the hammer 2 against the hammer support portion 9*a* of the support member 9, thereby preventing the key 1 and the hammer 2 from easily dropping off the chassis 4.

The hammer 2 always urges the key 1 upward via its lower extension 2*b*, due to the weight of a mass member 2*f* thereof. It should be noted that a force for returning the key 1 to its original position is not imparted by the spring 7 but by the restitutive force of the hammer 2. The hammer 2 is formed with a switch-actuating section 2*e* on an underside thereof, for actuating the switch section 3.

The chassis 4 has an upper stopper 10 (stopper portion) and a lower stopper 11 both made of felt or the like, arranged, respectively, at a rear end portion of the chassis-horizontal part 4*a* and a chassis-holding portion 4*c*. The mass member 2*f* of the hammer 2 abuts the upper stopper 10 when the key 1 is depressed, whereby respective pivotal motion-terminating positions of the key 1 and the hammer 2 are set (for the key 1, a lower limit position of a front end thereof, while for the hammer 2, an upper limit position of the free end 2*d* thereof), and abuts the lower stopper 11 when the key 1 is released, whereby an upper limit position of the key 1 is set.

The chassis-front part 4*b* has a switch board 8 attached thereto, and the switch section 3 is arranged on the switch board 8. The switch section 3 is provided for each hammer 2 in opposed relation to the switch-actuating portion 2*e* of the hammer 2. The switch section 3 is a three-make touch-response switch of a contact point-time difference type and detects the key-depressing motion of the key 1.

Figure 2:
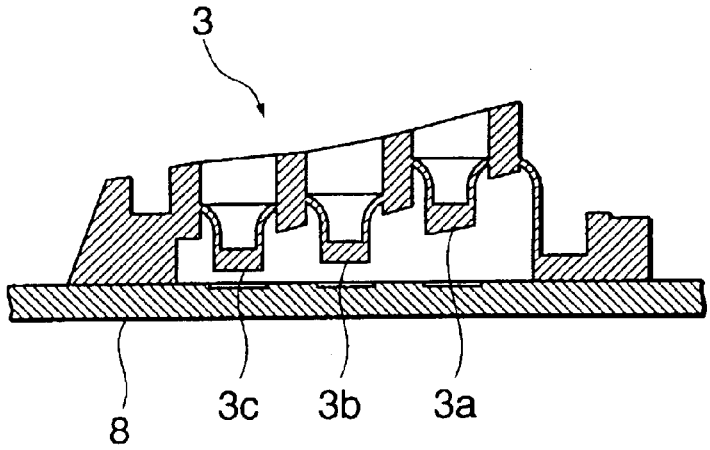
FIG. 2 is an enlarged cross-sectional view of a switch section arranged on a switch board appearing in FIG. 1.

FIG. 2 is an enlarged cross-sectional view of a switch section 3 arranged on the switch board 8. As shown in the figure, the switch section 3 is comprised of a first switch (SW) 3*a*, a second switch (SW) 3*b*, and a third switch (SW) 3*c*.

Figure 3:
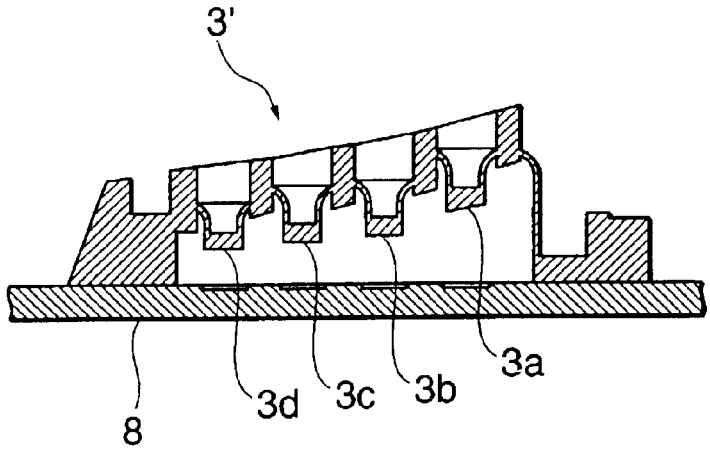
FIG. 3 is an enlarged cross-sectional view of the switch section when a four-make touch-response switch is employed.

It should be noted that although in the present embodiment, the three-make touch-response switch is employed as the switch section 3, this is not limitative, but a four-make touch-response switch as shown in FIG. 3 may be used as a switch section 3', or even a switch of five or more-make type may be used. Further, the means for realizing the function of the switch section 3 is not limited to switches, but any suitable device may be employed insofar as it can output a signal representing a depression of the key 1. For example, there may be employed a piezo sensor that detects pressure applied to the key 1 when the key 1 is depressed.

Further, one of the characteristics of the electronic keyboard musical instrument according to the present embodiment consists in control of a musical tone using a position of a key in which if the key were of an acoustic piano (hereinafter referred to as "the real piano"), a corresponding string would touch a damper member upon key release, as a turning point. If the player can recognize this position by his sense of feeling via the key 1 upon release (or depression) thereof, he can actively make use of this feature of musical tone control. Therefore, it is desirable that the electronic keyboard musical instrument enables the player to feel this position.

Figure 4:
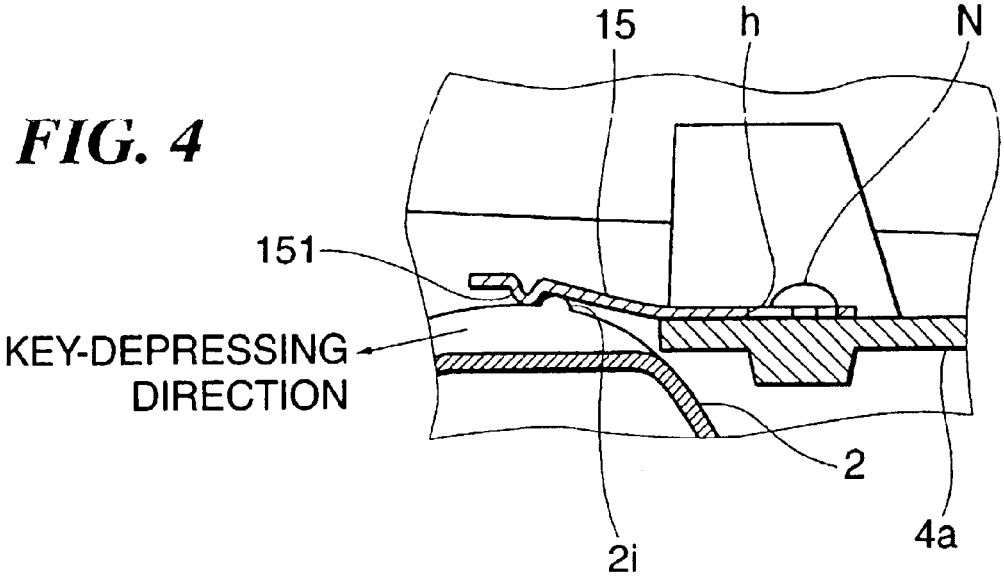
FIG. 4 is a view showing an example of an arrangement that enables a player to sense a position of a key in which if the key were of an acoustic piano, a corresponding string would touch a damper member upon key release.
Figure 5:
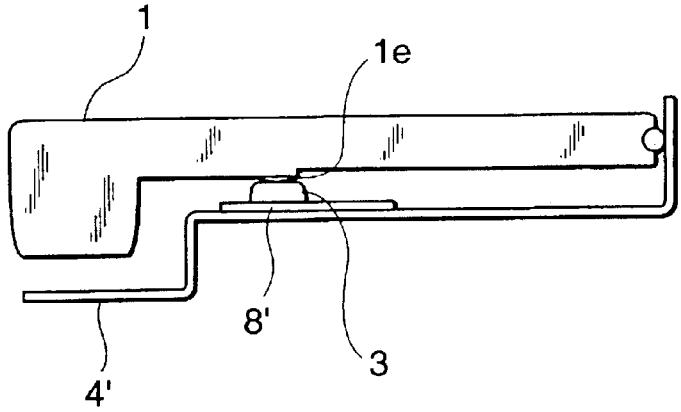
FIG. 5 is a view showing another example of a method of actuating the switch section.

FIG. 4 is a view showing an example of an arrangement for enabling the player to feel this position. It should be noted that FIG. 4 is an enlarged fragmentary view of an electronic keyboard musical instrument according to another embodiment of the invention, which is configured similarly to the present embodiment, essential parts of which are shown in FIG. 1, except for members 2*i*, 15, etc. appearing in FIG. 4.

As shown in FIG. 4, a protrusion 2*i* is formed on the hammer 2, and a leaf spring 15 with a protruding strip 151 is fixed to an end of the chassis-horizontal part 4*a* with a screw N, such that the protruding strip 151 of the leaf spring 15 is brought into contact with the protrusion 2*i* in the course of depression of the key 1. As the key 1 is depressed, the protrusion 2*i* slides on the surface of the leaf spring 15, and when it comes to a point at which it is about to climb on the protruding strip 151, the player can sense a feeling of resistance during sliding or a feeling of clicking. Further, by adjusting the position or shape of the leaf spring 15, this point can be finely adjusted to a position of the key 1 in which if the key 1 were of the real piano, a corresponding string would touch a damper member of the real piano. To this end, a slot associated with the screw N is formed in the leaf spring 15. Further, the above fine adjustment can be effected by fine displacement of the position of the switch section 3, 3' in the longitudinal direction of the key 1.

Further, although in the present embodiment, the switch section 3 is configured such that it is actuated by the switch-actuating portion 2*e* pred on the key 1.

Figure 6:
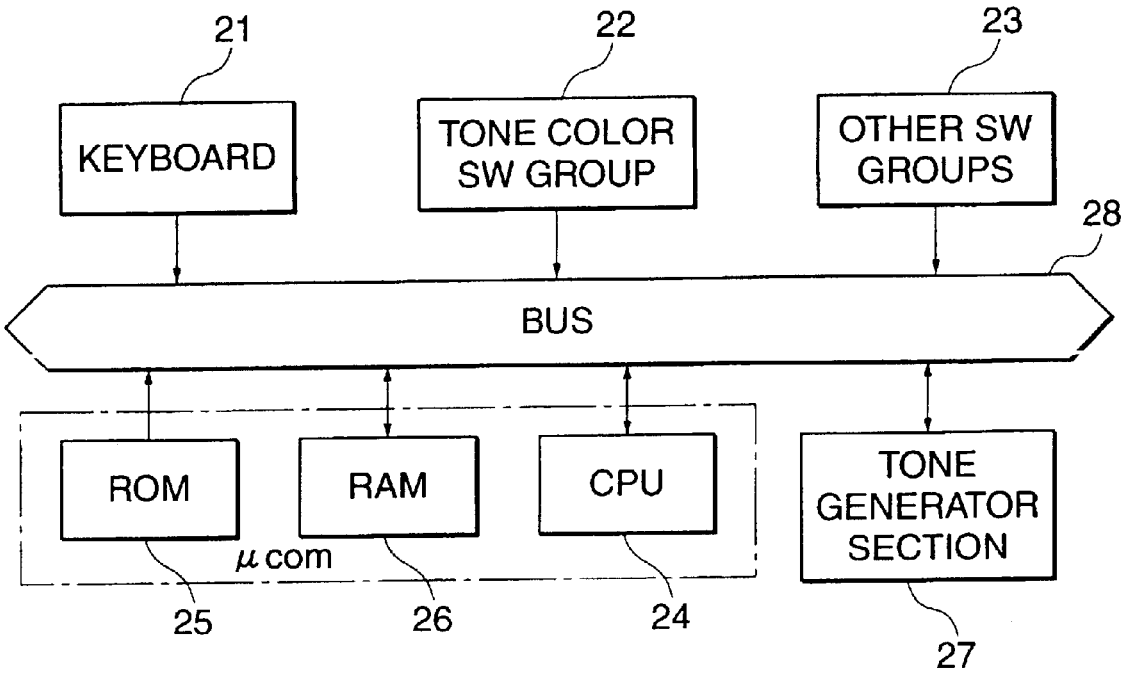
FIG. 6 is a block diagram showing the arrangement of control function blocks of the electronic keyboard musical instrument according to the present embodiment.

FIG. 6 is a block diagram showing the arrangement of control function blocks of the electronic keyboard musical instrument according to the present embodiment.

As shown in the figure, the electronic keyboard musical instrument according to the present embodiment is comprised of a keyboard 21 for inputting pitch information, a tone color switch (SW) group 22 comprised of a plurality of switches for designating various tone colors, another switch (SW) group 23 comprised of a plurality of switches for inputting various kinds of information other than the tone colors, a CPU 24 for control of the whole musical instrument, a ROM 25 storing control programs executed by the CPU 24, various table data, and so forth, a RAM 26 for temporarily storing various items of input information, computation results, and so forth, and a tone generator section 27 for generating a musical tone waveform signal based on performance data input from the keyboard 21 or set in advance, and converting the musical tone signal waveform into a sound.

It should be noted that although in the present embodiment, the CPU 24, the ROM 25, and the RAM 26 are implemented by a one-chip microcomputer, of course, this is not limitative, but the CPU 24, the ROM 25, and the RAM 26 may be implemented by respective separate or discrete devices.

Figure 7:
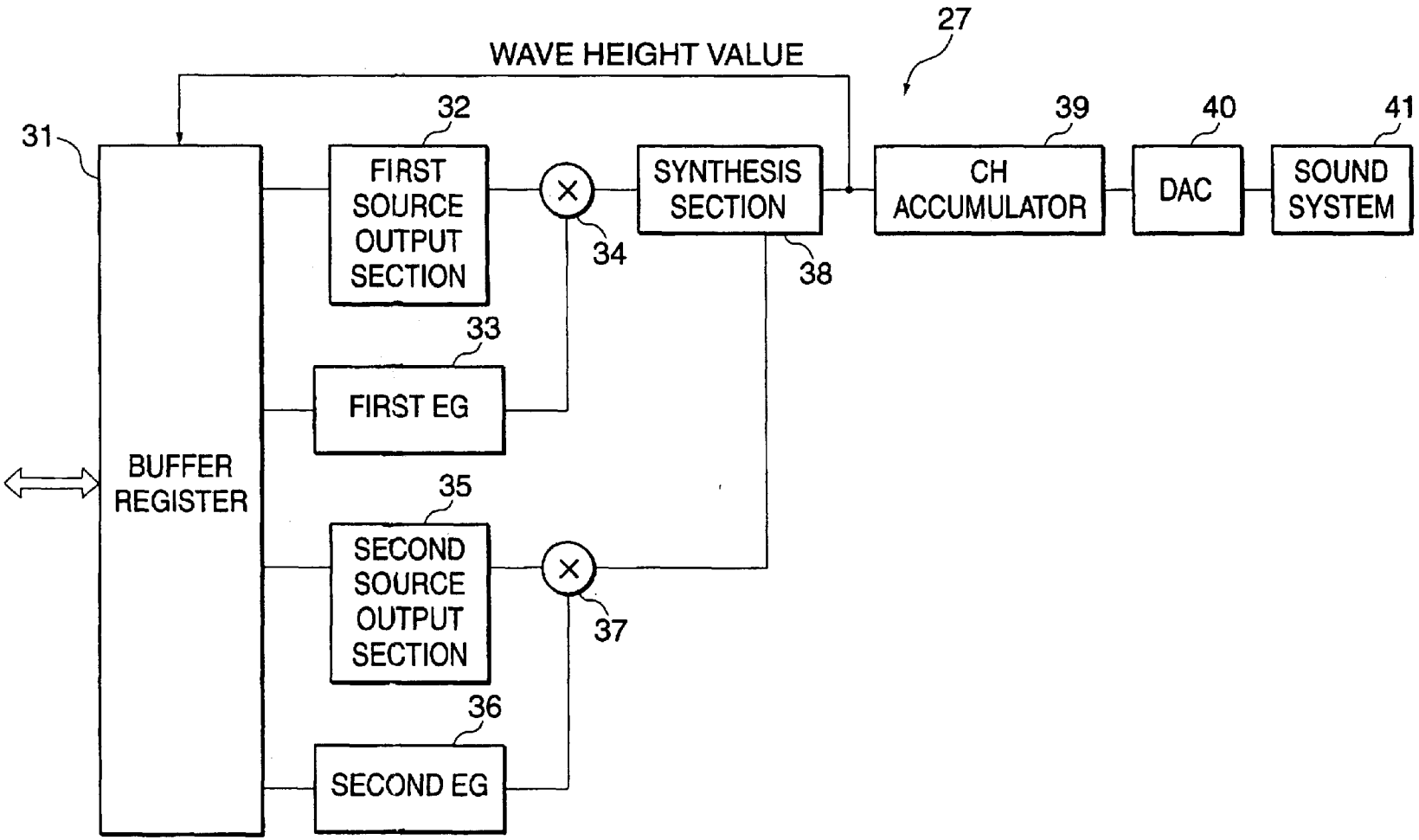
FIG. 7 is a block diagram showing details of control function blocks of a tone generator section appearing in FIG. 6.

FIG. 7 is a block diagram showing details of control function blocks of the tone generator section 27.

As shown in the figure, a buffer register 31 comprised of a plurality of areas for storing various parameters necessary for generating waveforms of a musical tone signal has connected thereto a first source output section 32 for outputting a source of a musical tone (first source) to be generated at the time of key-on, a first envelope generator (EG) 33 for generating an envelope of the first source thus output, a second source output section 35 for outputting a source of a musical tone (second source) to be generated at the time of key-off, and a second envelope generator (EG) for generating an envelope of the second source thus output. Here, the first source is data prepared by sampling a musical tone of a grand piano generated from a start of key depression and during the key depression (not including time during which the key 1 is being released), and recording the sampled musical tone, while the second source is data prepared by sampling a musical tone of the grand piano generated during damping when the key 1 is released.

The first source output from the first source output section 32 is multiplied by the envelope output from the first EG 33 by a multiplier 34 and then supplied to a synthesis section 38, while the second source output from the second source output section 35 is similarly multiplied by the envelope output from the second EG 36 by a multiplier 37 and then supplied to the synthesis section 38.

The synthesis section 38 synthesizes the first and second sources output from the multipliers 34 and 37, respectively, that is, the first and second sources having their envelopes controlled, and supplies the resulting synthesized waveform data to a channel (CH) accumulator 39. Further, a wave height (amplitude) value of the synthesized waveform output from the synthesis section 38 is always detected in predetermined timing, and stored in a predetermined area of the buffer register 31. Although not shown, a wave height value of the waveform of the first source having the envelope added thereto output from the multiplier 34 is also always detected in predetermined timing and stored in a predetermined area of the buffer register 31. These wave height values thus stored are used in processing (executed in steps S35 and S33) described hereinafter with reference to a flowchart shown in FIG. 13.

It should be noted that the blocks 32 to 38 perform respective processes by time-sharing for each channel. Of course, if the manufacturing costs can be disregarded, the configuration of the tone generator section 27 need not be limited to this configuration, but one set of blocks 32 to 38 can be provided for each channel.

Figure 8:
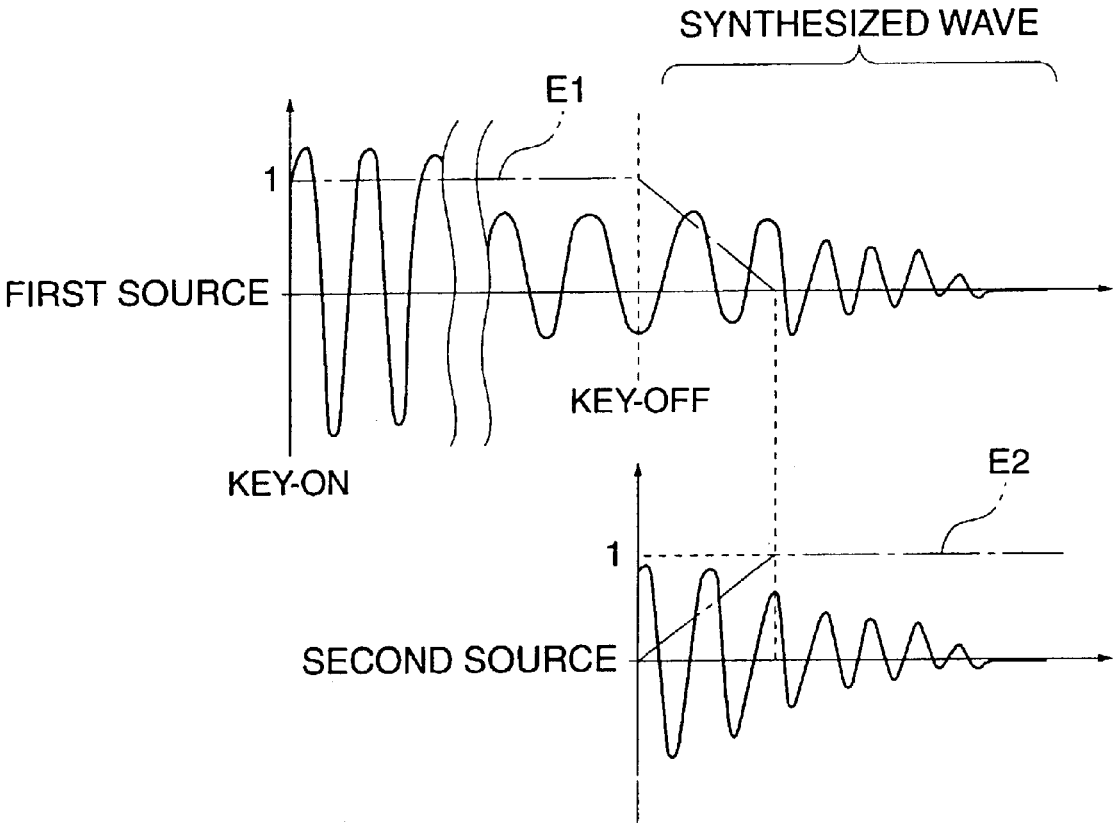
FIG. 8 is a diagram showing an example of a synthesized wave of one tone-generating channel delivered from a synthesis section appearing in FIG. 7.

FIG. 8 is a diagram showing an example of a synthesized wave of a certain tone-generating channel delivered from the synthesis section 38, in which is illustrated a waveform of a musical tone output from the time of key-on to the time of complete damping by key-off.

In the figure, during key-on, the musical tone waveform of the first source is delivered from the first source output section 32, and at the same time, from the first EG 33, an envelope waveform E1 having a value of 1 is delivered, but no signal waveforms are delivered from the second source output section 35 and the second EG 36. Accordingly, the synthesis section 38 delivers the musical tone waveform of the first source as it is.

If key-off is started from this key-on status, the first source output section 32 continues to deliver the musical tone waveform of the first source, but the level of the envelope waveform E1 delivered from the first EG 33 is progressively damped, and further, the second source output section 35 starts to deliver the musical tone waveform of the second source and the envelope waveform E2 delivered from the second EG 36 is linearly increased. Accordingly, the synthesis section 38 delivers a waveform which is being cross-faded from the musical tone waveform of the first source to that of the second source.

Then, upon completion of the cross-fading, the level of the envelope waveform E1 delivered from the first EG 33 becomes equal to "0", while that of the envelope waveform E2 of the second EG 36 becomes equal to "1". Accordingly, the synthesis section 38 delivers the musical tone waveform of the second source as it is. The musical tone waveform of the second source has a characteristic that the wave height value thereof is progressively damped, and hence even though the level of the envelope waveform E2 delivered from the second EG 36 remains equal to "1", the tone damping is naturally completed in a predetermined time period.

Referring again to FIG. 7, the CH accumulator 39 accumulates the synthesized waveforms of the tone-generating channels delivered from the synthesis section 38 for all the tone-generating channels, and supplies the accumulated digital musical tone signal waveform to a DAC (Digital-to-Analog Converter) 40 for conversion of the digital signal to an analog signal. The analog musical tone signal waveform delivered from the DAC 40 is supplied to a sound system 41 comprised of an amplifier and loudspeakers, where the signal is converted to a sound.

The control processes executed by the electronic keyboard musical instrument constructed as above will be described, first in outline with reference to FIG. 9, and then in detail with reference to FIGS. 10 to 16.

Figure 9:
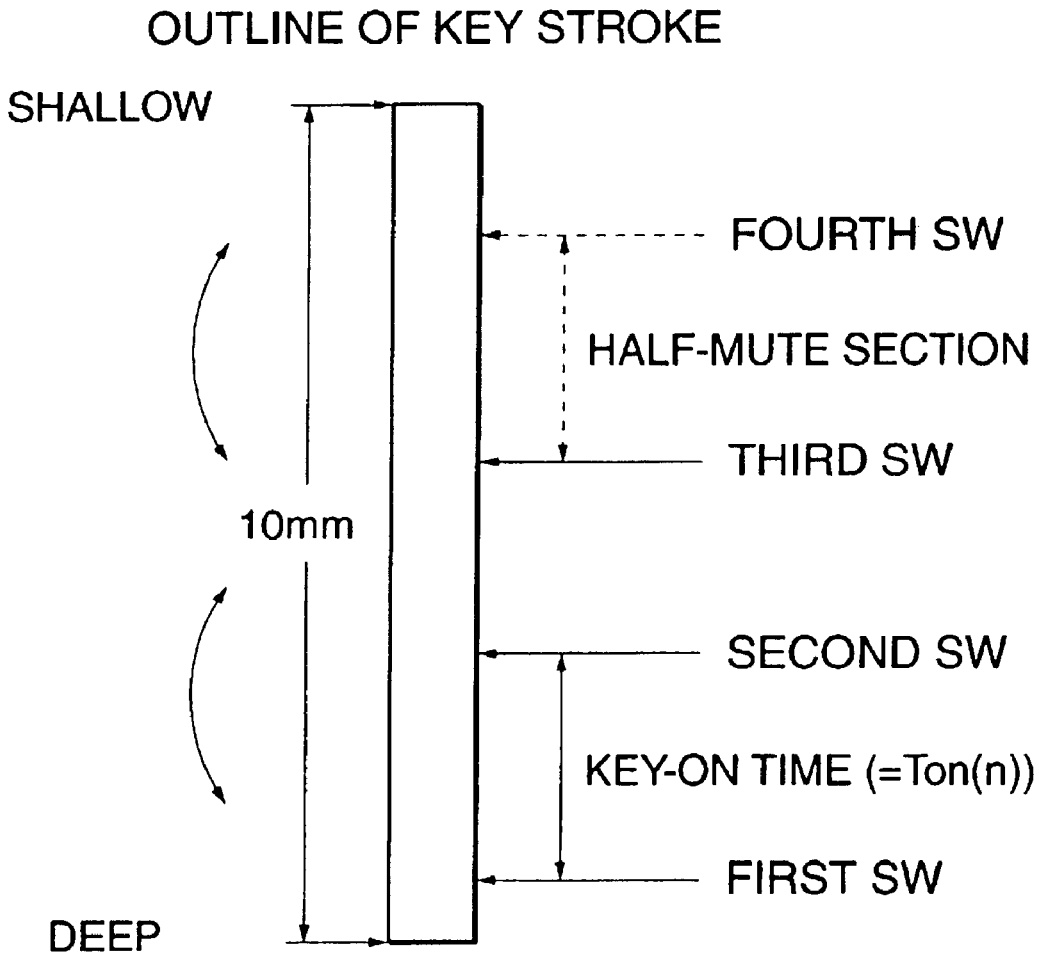
FIG. 9 is a diagram showing respective ON positions in a key stroke associated with a first switch (SW) to a third switch (SW) of the switch section.

FIG. 9 is a diagram showing ON positions (timings) in a key stroke associated with the first SW to the third SW of the switch section 3, respectively. It should be noted that FIG. 9 also illustrates an ON position of the fourth SW 3*d* taken when the four-make touch-response switch shown in FIG. 3 is employed.

As shown in FIG. 9, in a real (acoustic) piano and an electronic keyboard musical instrument, the key 1 is displaced vertically through a maximum of approximately 10 mm from the key-released (non-key-depression) position to the most deeply depressed position. The electronic keyboard musical instrument according to the present embodiment is also constructed according to such a specification. As the key 1 is depressed along the key stroke, first the third SW 3*c*, then the second SW 3*b*, and lastly the first SW 3*a* are turned ON.

After the start of key depression, when the third SW 3*c* is first turned on (when an ON event of the third SW 3*c* occurs), an unused or free one of the tone-generating channels is searched for to prepare for tone generation. Then, when the second SW 3*b* is turned on (when an ON event of the second SW 3*b* occurs), a time (key-on time) for defining a key-on velocity starts to be measured. Then, when the first SW 3*a* is turned on (when an ON event of the first SW 3*a* occurs), the measurement of the time is stopped, and based on the measured time, i.e. a time period from a time point the second SW 3*b* is turned on to a time point the third SW 3*a* is turned on, e.g. table data (see FIG. 15) is looked up to thereby determine a key-on velocity. When this key-on velocity is sent out together with a key code corresponding to the depressed key, a channel number of the unused channel found by the search, and data of key-on etc., to the tone generator section 27, the tone generator section 27 generates a musical tone having a pitch corresponding to the depressed key and the determined key-on velocity.

Next, in this state, if the key 1 is operated in a key-releasing direction so that the second SW 3*b* is turned off (an OFF event of the second SW 3*b* occurs) and then without the third SW 3*c* being turned off (without occurrence of an OFF event of the third SW 3*c*), the second SW 3*b* and the third SW 3*c* are turned on again in this order, the key-on velocity is determined again as described above, whereby a musical tone having a pitch corresponding to the depressed key is produced by the tone generator section 27. In this case, however, as a tone-generating channel for producing the musical tone, a different channel from the preceding one assigned to the depressed key on an immediately preceding occasion is assigned. That is, according to the present embodiment, until the key-off is effected, all the tone-generating channels are made available for assignment except ones being in use. This makes it possible to obtain an musical tone effect as would be produced with the real piano when a key is repeatedly struck, with a damper pedal being continuously stepped on. Actually, in the real piano, if the key depression is carried out repeatedly with the damper pedal being continuously stepped on, all the strings are vibrated at the pitch of the struck string, which produces a musical tone effect of a spreading feeling. In contrast, in the electronic keyboard musical instrument according to the present embodiment, a plurality of musical tones having the same pitch are produced.

Further, a musical tone can be produced without returning the key 1 to its key-off position, that is, the position where, in the present embodiment, the third SW 3*c* is turned off, and hence, it is possible to play fast (quickly repeatedly depress keys for) a passage of a musical piece for fast performance.

On the other hand, when the second SW 3*b* is turned off, if the key 1 is further operated in the key-releasing direction to turn off the third SW 3*c*, the tone generator section 27 is caused to start to read a musical tone of the aforementioned second source (see FIG. 8), and instructed to perform cross-fading from the musical tone being generated, i.e. the musical tone of the first source, to the musical tone of the second source. Then, by setting the position at which the third SW 3*c* is turned off such that it is equivalent to a damper-leaving position in the key stroke of the real piano, the performance feeling given by the electronic keyboard musical instrument according to the present embodiment is made closer to the performance feeling given by the real piano, especially, a grand piano.

Further, in the case that the four-make touch-response switch is employed as the switch section 3, in addition to the control processes described above when the three-make touch-response switch is employed, a section between the fourth SW 3*d* and the third SW 3*c* can be set to a control section during which harmonics to be superimposed on the string vibration are changed by changing a degree of touching of the string on the damper member in the case of the real piano, i.e. a half-muting section. More specifically, by operating the key 1 in the key-depressing direction, when the third SW 3*c* is turned on (after the fourth SW 3*d* is turned), a predetermined value defined by a plurality of bits (e.g. 11B, wherein "B" is a symbol indicating the preceding numerical is a binary number, and this applies hereinafter) is assigned to a marker indicative of one end of the half-muting control section reached when the key 1 is operated in one direction, and on the other hand, by operating the key 1 in the key-releasing direction, when the fourth SW 3*d* is turned off (after the third SW 3*c* is turned off), a predetermined value defined by a plurality of bits (e.g. 00B) is assigned to a maker indicative of the other end of the half-muting control section reached by operating the key 1 in the other direction. Thus, depending on the case, either a value of 00B or a value of 11B is given, and according to the given value, the degree of half muting, i.e. the kind of harmonics to be superposed on the string vibration can be changed.

It should be noted that by using a switch having a larger number of make contacts, or a sensor outputting a large number of discrete values (or continuous value) according to the operated state of the key 1, it is possible to perform more accurate half-muting control. Of course, the above-mentioned section, i.e. the section during which a value (intermediate value) between the predetermined values assigned to the opposite ends the section, respectively, and each defined by a plurality of bits may be used for other purposes than the half-muting control. For instance, between the synthesis section 38 and the channel accumulator 39 in FIG. 7, a waveform slicer section may be arranged for slicing the synthesized waveform output from the synthesis section 38 to output the sliced portions of the waveform, and a degree of chopping may be controlled according to the output intermediate value.

Further, in the present embodiment, values each defined by a plurality of bits are assigned to the markers indicative of the opposite ends of the predetermined section, respectively, and hence, irrespective of the number of make contacts in the case that a switch is used, or irrespective of the number of output values in the case that a sensor for outputting a larger number of discrete values (continuous value) according to the operated state of the key 1 is used, the same sounding system can be applied. Therefore, even when the number of make contacts of each switch or the number of output values of the sensor is increased, the whole sounding system need not be modified very much. This makes it possible to realize a more advanced sounding system while suppressing the cost of development, i.e. contributes to commonality of systems.

Next, the above control processes will be described in detail.

Figure 10:
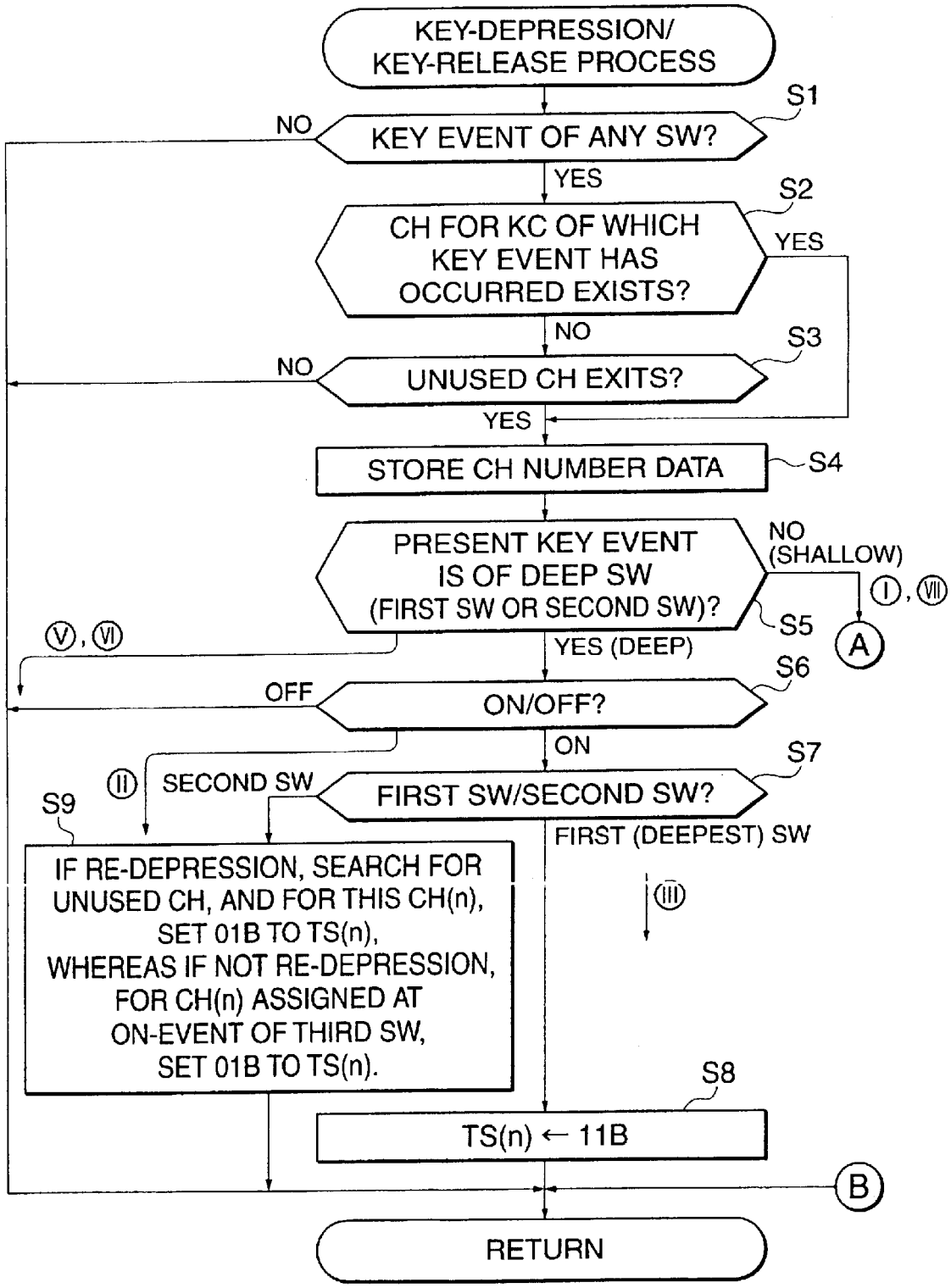
FIG. 10 is a flowchart showing a key-depression/key-release process subroutine executed by the FIG. 6 electronic keyboard musical instrument, particularly by a CPU thereof.
Figure 11:
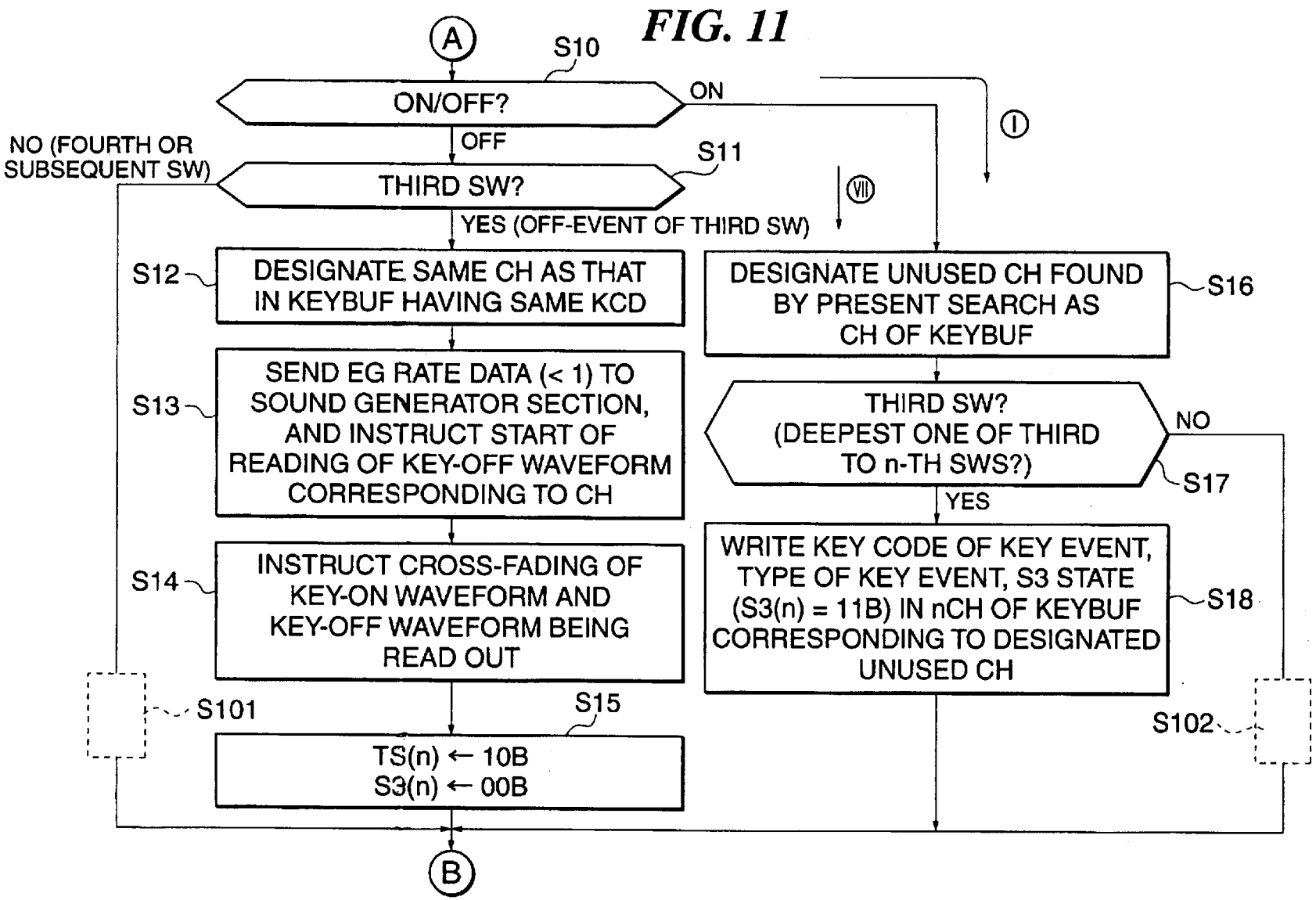
FIG. 11 is a continued part of the flowchart of the FIG. 10 subroutine.

FIGS. 10 and 11 show a flowchart of a key-depression/key-release process subroutine executed by the electronic keyboard musical instrument, particularly by the CPU 5, of the present embodiment. This key-depression/key-release process subroutine is executed as one of processes of a main routine. It should be noted that the main routine may be comprised of known processes executed by the conventional electronic keyboard musical instrument, such as initialization, tone color setting, and other processes, in addition to the present key-depression/key-release process subroutine, and hence illustration of the main routine is omitted.

Figure 12:
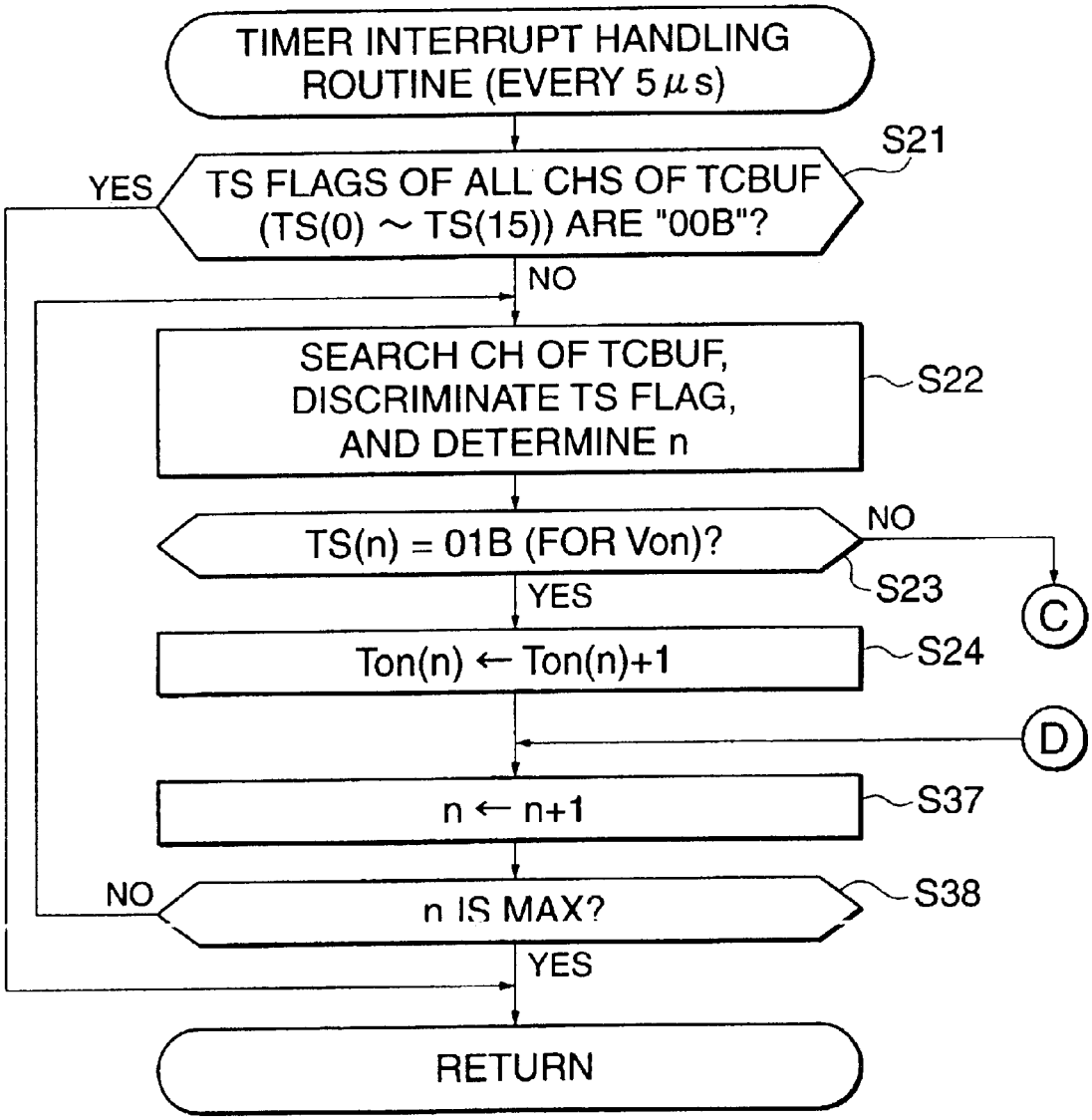
FIG. 12 is a flowchart showing a timer interrupt handling routine executed by the FIG. 6 electronic keyboard musical instrument, particularly by the CPU thereof.
Figure 13:
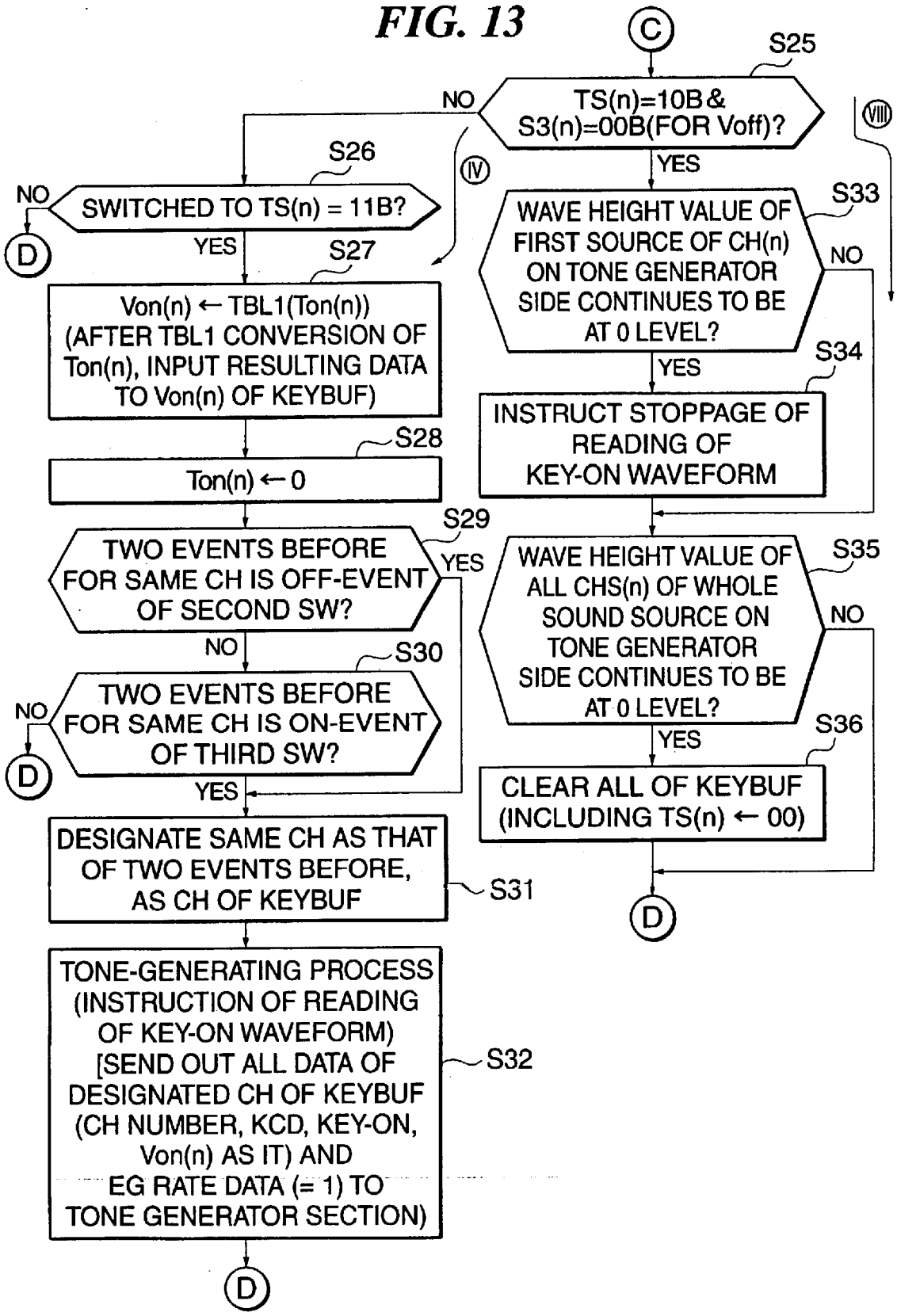
FIG. 13 is a continued part of the flowchart of the FIG. 12 timer interrupt handling routine.
Figure 15:
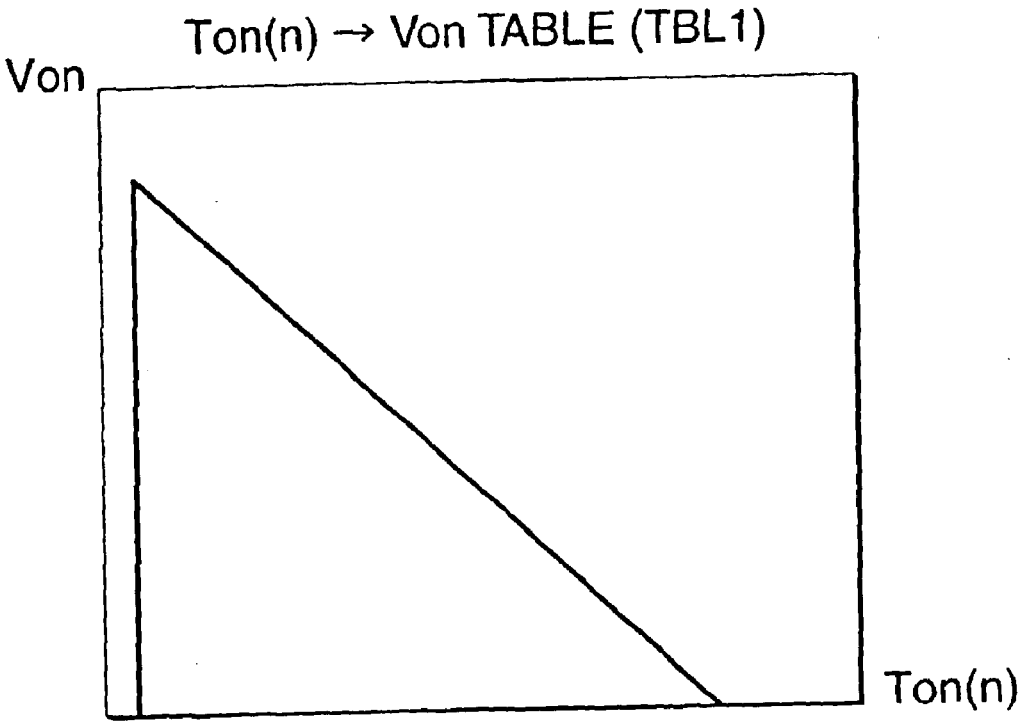
FIG. 15 is a diagram showing an example of a conversion table for converting a key-on time to a key-on velocity.

FIGS. 12 and 13 show a flowchart of a timer interrupt handling routine executed by the electronic keyboard musical instrument, particularly by the CPU 5, of the present embodiment. This time interrupt handing routine is started in response to a timer interrupt signal whenever a timer, not shown, counts e.g. 5 $\mu$seconds.

In the flowcharts of FIGS. 10 to 13, main processes of the routine are executed when a key event (key-on/key-off event) of any of the first SW 3*a* to the third SW 3*c* occurs, and therefore, a description will be given of a control process to be carried out in each of cases classified as follows:

I. An ON event of the third SW 3*c* occurs.

II. An ON event of the second SW 3*b* occurs.

III. An ON event of the first SW 3*a* occurs.

IV. A tone-generating process.

V. An OFF event of the first SW 3*a* occurs.

VI. An OFF event of the second SW 3*b* occurs.

VII. An OFF event of the third SW 3*c* occurs.

VIII. A tone-damping process.

It should be noted that the numbers I to VIII are made correspondent to the numbers used in the flowcharts of FIGS. 10 to 13.

I. When an ON event of the third SW 3*c* occurs, a key code KC indicative of occurrence of this ON event is not yet registered in an area KCD (see FIG. 14A) of the buffer KEYBUFF, and hence, an unused channel (CH) is searched for, and when it is found, channel (CH) number data of the unused channel is temporarily stored in a predetermined area of the RAM 26 (steps S1→S2→S3→S4 in FIG. 10).

FIGS. 14A to 14C are diagrams showing formats of a buffer area and a timer area allocated in the RAM 26. FIG. 14A shows a format of the buffer KEYBUF for storing tone-generating information and tone-damping information of each channel. FIG. 14B shows a format of a buffer TS&S3BUF for storing a touch state TS(k) and a switch-S3 (third SW 3*c*) state S3(*k*). FIG. 14C shows a software counter area for counting a key-on time for each channel.

As shown in FIG. 14A, the buffer KEYBUF is comprised of the area KCD for storing key code data, a type area for storing key event type data, a Von(n) area for storing key-on velocity data, and an EG rate area for storing EG rate data, which are assigned to each of 16 tone-generating channels (0CH to 15CH).

The key event type data is for distinguishing between a key-on event (ON event) and a key-off event (OFF event), and is represented by one-bit data. That is, 1 represents an ON event, while 0 represents an OFF event.

Referring again to FIG. 10, this ON event is of a shallow SW as shown in FIG. 9, and therefore, the process proceeds from a step S5 to a step S16 (in FIG. 11), whereby the unused channel (CH) found out by the present search is designated as a channel (CH) of the buffer KEYBUF, and since the third SW 3*c* is the deepest of shallow switches (in the present switch, only one shallow switch exists), the key code and the key event type of the key event are written in the nCH of the buffer KEYBUF, and the value 11B is written in an area S3(*n*) of the buffer TS&S3BUF where a state (hereinafter referred to as "S3(*n*)") of the switch-S3 (third SW 3*c*) is stored (steps S17→S18).

As shown in FIG. 14B, the buffer TS&S3BUF is comprised of an area for storing a touch state TS(k), and an area for storing a switch-S3 (third SW 3*c*) state S3(*k*), which are assigned to each of the 16 tone-generating channels (0CH to 15CH).

The touch state TS(k), as shown in FIG. 14B, selectively assumes one of four values of 00B, 01B, 10B, and 11B, which represent respective states as follows:

TS(k)=00B: a state of a musical tone not being generated;

TS(k)=01B: a state of the second SW 3*b* being ON;

TS(k)=10B: a state of the third SW 3*c* being OFF after a musical tone starts to be generated; and TS(k)=11B: a state of the first SW 3*a* being ON.

The switch-S3 state S3(*k*) selectively assumes, as shown in FIG. 14B, one of two values of 00B and 11B, which represent respective states of the third SW 3*c* as follows:

S3(*k*)=00B: a state of the third SW 3*c* being OFF; and

S3(*k*)=11B: a state of the third SW 3*c* being ON.

It should be noted that when the four-make touch-response switch is employed as the switch 3, the values of the switch-S3 state S3(*k*) represent the states thereof as follows:

S3(*k*)=00B: a state of the fourth SW 3*d* being OFF; and

S3(*k*)=11B: a state of the third SW 3*c* being ON.

II. When an ON event of the second SW 3*b* occurs, the key code for this ON event is already stored in the area KCD of the buffer KEYBUF, and hence the CH number data is temporarily stored without carrying out a search for an unused CH (steps S1→S2→S4). Further, since this ON event is, as shown in FIG. 9, of a deep switch, the process proceeds in the order of steps S5→S6→S7, and further, since it is of the second SW 3*b*, the process proceeds from the step S7 to a step S9, wherein for the CH(n) assigned at the time of turn-on of the third SW 3*c*, a value 01B is written in the area TS(n) of the buffer TS&S3BUF (this process is for a case of the key 1 not being depressed again, and a process for a case of the key 1 being depressed again will be described hereinafter). This causes the subroutine in the FIG. 12 flowchart to proceed in the order of steps S21→S22→S23→S24, so that the counting operation using a counter area Ton(n) for nCH is started. That is, a key-on time for nCH starts to be measured.

III. When an ON event of the first SW 3*a* occurs, up to the step S7, the same process as carried out in the case of II is carried out, and since this ON event is of the first SW 3*a*, the process proceeds from the step S7 to a step S8, wherein a value of 11B is written in the area TS(n) of the buffer TS&S3BUF.

IV. When a tone-generating process is carried out, since it is when the touch state TS(n) stored in its area TS(n) is switched to a value of 11B, the process proceeds in the order of steps S21→S22→S23 (of FIG. 12)→S25 →S26→S27 (of FIG. 13). At this time, the counter area Ton(n) stores a value counted over a time period during which the area Ts(n) stores a value of 01B, and hence after the counted value is subjected to TBL1 (see FIG. 15) conversion (i.e. determining a key-on velocity by looking up the Ton(n)-to-Von table (TBL1), the resulting value is inputted to the area Von(n) of the buffer KEYBUF, and the counter area Ton(n) is reset to "0". Then, in steps S29 and S30, an erroneous key depression is excluded, and for a standard key depression and a trill key depression, the process proceeds to a step S31.

Figure 16:
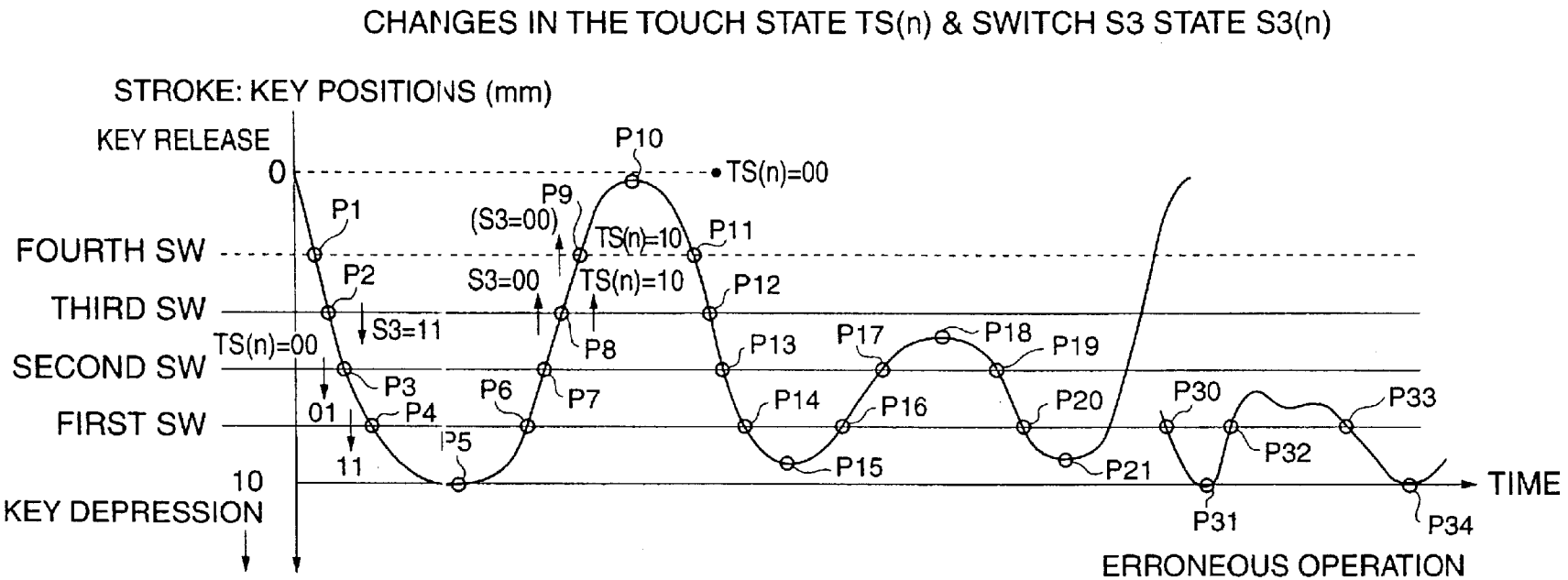
FIG. 16 is a diagram showing changes in the touch state TS(n) & switch S3 state S3(*n*)

FIG. 16 is a diagram showing changes in the touch state TS(n) & switch-S3 state S3(*n*).

A term "standard key depression" is intended to mean a key depression that produces ON/OFF events by all of the first SW 3*a* to the third SW 3*c*. More specifically, in FIG. 16, it means a key depression that goes from a position P1 to a position P15. In this standard key depression, an event two events before a position P14 is an ON event by the third SW 3*c*. A term "trill key depression" is intended to mean a key depression that produces ON/OFF events only by the first SW 3*a* or the second SW 3*b*. More specifically, in FIG. 16, it means a key depression that goes from the position P15 to a position P21. In this trill key depression, an event two events before a position P20 is an OFF event of the second SW 3*b*. Further, a term "erroneous key depression" is intended to mean a key depression that produces an ON/OFF event only by the first SW 3*a*. More specifically, in FIG. 16, it means a key depression that goes from a position P30 to a position P34. In this erroneous key depression, an event two events before the position P33 is an ON event by the first SW 3*a*.

Referring again to FIG. 13, in a step S31, the same CH that is assigned to an event of the same key 1 which is two events before concerning the same key 1 is designated as the CH of the buffer KEYBUF, and in a step S32, a tone-generating process is carried out for the designated CH. In the tone-generating process, all data of the designated CH of the buffer KEYBUF, that is, a CH number, KCD, Von(n) as data of key-on and initial touch (IT), and EG rate data (=1), are sent out to the tone generator section 27.

V. When an OFF event of the first SW 3*a* occurs, and VI. when an OFF event of the second SW 3*b* occurs, the key-depression/key-release process is terminated without carrying out any substantial processing.

VII. When an OFF event of the third SW 3*c* occurs, the process proceeds from the step S5 in FIG. 10 to steps in FIG. 11 in the order of S10→S11→S12, wherein the same CH as that of the buffer KEYBUF for which the same KCD is stored is designated, and the EG rate data (<1) is transmitted to the tone generator section 27 and the start of reading of key-off waveform (second source waveform) corresponding to the CH is instructed in a step S13. In a step S14, the start of cross-fading on the key-on waveform and the key-off waveform being read out is instructed, and in a step S15, a value of 10B is inputted to the touch state TS(n) stored in its area TS(n) of the buffer KEYBUF and a value of 00B is inputted to the switch-S3 state S3(*n*) stored in its area S3(*n*) of the same.

VIII. When a tone-damping process is executed, it is the case of TS(n)=10B and S3(*n*)=00B, and hence the process proceeds in the order of steps S21→S22→S23 (in FIG. 12)→S25→S33 (in FIG. 13), wherein in the case of the wave height value of the first source of the CH(n) on the side of the tone generator section 27 is continuously at 0 level, the stop of reading of the key-on waveform is instructed (steps S33→S34), whereas in the case of the wave height values of all the channels of the whole sound source on the side of the tone generator section 27 are at 0 level, the buffer KEYBUF is entirely cleared (steps S35→S36).

Next, a description will be given of key re-depression before key-off is not completely effected, that is, a key depression in the case that after the tone generating process IV, described above, OFF events of the first SW 3*a* and second SW 3*b* occur (processes V and VI, described above), and then ON events of the second SW 3*b* and the first SW 3*a* occur in this order (processes II and III, described above), with reference to FIGS. 10 to 13 and 16.

This key re-depression before the key-off is completely effected corresponds to a key depression that goes from a position P18 to the position P20 in FIG. 16. This operation will be described starting with a position P10 a little before the position P18. When the key depression proceeds from the position P10 to the position P14, the tone-generating process (steps S27 to S32) of the above-described process IV, in the timer interrupt handling routine of FIGS. 12 to 13, is carried out, whereby a musical tone having a key-on velocity corresponding to a key-on time counted from the position P13 to the position P14 is generated via an unused CH found out by the search. Then, a key release proceeds from the position P15 via the position P17, that is, via occurrence of an OFF event of the second SW 3*b*, to the position P19, whereupon a CH different from the CH in which the above musical tone is being generated is searched for, and counting of a key-on time for the key re-depression is started in the step S9. When a key depression proceeds to the position P20, a musical tone having a key-on velocity corresponding to a key-on time counted from the position P19 to the position P20 is generated in the unused CH found out by the search.

Here in the step S9, as shown in FIG. 10, it is determined whether the present event indicates a key re-depression, and if so, a value of 01B is set to a touch state TS(n) for an unused CH(n) newly found out. That is, the musical tone to be generated is assigned to a new unused CH. This is because in the steps S31 and S32 in FIG. 13, the same CH as that for an event two events before the present event is designated to assign the musical tone thereto, and hence in the key re-depression, the same musical tone is assigned to the same CH, but the same musical tone is not assigned to another CH whenever the key re-depression occurs, differently from the above case. In contrast, when the step S9 is configured as described above, when a key re-depression occurs, the musical tone is assigned to another unused CH, and hence as a key re-depression repeatedly occurs, the same musical tone is not sequentially assigned to other CHs. It should be noted that whether the present event indicates a key re-depression can be determined by determining whether or not an event which is two events before the present event for the same CH is an OFF event of the second SW 3*b*, similarly to the step S29 in FIG. 13, and when the event is an OFF event of the second SW 3*b*, it can be determined that the present event indicates a key re-depression, since in FIG. 16, two events before the event of the position P20, i.e. a position of occurrence of a key re-depression, in the same CH, that is, the event of the position P17 is an OFF event of the second SW 3*b*.

Since in such a key re-depression, the key-off is not completely effected, i.e. an key-off event of the third SW 3*c* does not occur, when a key re-depression, such as a key depression from the position P19 to the position P20, occurs, the process II or III in FIG. 10 is carried out, but the key-off process from the steps S12 to S15 in FIG. 11 is not carried out. As a result, the process of the step S36 in FIG. 13, i.e. the operation of entirely clearing the buffer KEYBUF is not carried out. In other words, a complete tone-damping or silencing process is not carried out. Therefore, as a key re-depression repeatedly occurs, a musical tone having the same pitch is sequentially assigned to other CHs, whereby a plurality of musical tones of the same pitch are sounded. This makes it possible to obtain a musical tone effect similar to one obtained from the real piano by repeated key depression with the damper pedal being continuously stepped on.

It should be noted that although in the present embodiment, even if an OFF event of one of the third SW to n-th SW other than the deepest one occurs in the step S17 of the key-depression/key-release process in FIG. 11, no process is carried out, this is not limitative, but a step S102 may be additionally provided, for counting a time interval between predetermined ON events (e.g. by the time interrupt handling routine in FIGS. 12 to 13), and the counted time interval may be used as further information for determining the initial touch. A concrete example of the further information may be preparation information for making preparations for tone generation. If the initial touch can be thus determined by taking the further information as well into account, it is possible to modify a tone color (harmonic components) or volume, depending on the further information, thereby obtaining articulations richer in variety. This increases the range of techniques for expression of music.

Further, in the present embodiment, although in the step S11 of the key-depression/key-release process in FIG. 11, no process is carried out, this is not limitative, but a step S101 may be additionally provided to read out a musical waveform of a third source for reproduction.

It should be noted that although in the present embodiment, when a waveform to be reproduced is shifted from a key-on waveform to a key-off waveform, cross-fading is carried out on these waveforms, this is not limitative, but when key-off is designated, a normal key-off process, that is, stoppage of reading of a key-on waveform may be carried out while at the same time executing a process of quickly damping the musical tone being produced, and on the other hand, independently of this process, when key-off is instructed, the reading of a key-off waveform may be started. In this case, immediately after the key-off process is started, the key-on waveform and the key-off waveform are simultaneously produced. Further in this case, it is necessary to set the wave height levels of the key-on waveform and the key-off waveform during the key-off process to the same level.

Further, although in the present embodiment, when a waveform to be reproduced is shifted from a key-on waveform to a key-off waveform, cross-fading on these waveforms is carried out, this is not limitative, but when second information corresponding to a key position closest to a non-key-depression position in the vicinity of an actuation-starting position of an actuating member when the actuating member returns, as recited in claim 2 appended hereto, is generated (an OFF event of the third SW 3*c* in FIG. 2 or an OFF event of the fourth SW 3*d* in FIG. 3), or second information corresponding to a key posiion second closest to the non-key-depression position is generated (an OFF event of the third SW 3*c* in FIG. 3), the above switching of waveforms may be carried out. In this case, without performing the cross-fading, the key-on waveform is turned OFF, that is, the musical tone of the key-on waveform is forcedly damped by EG, and the key-off waveform is turned ON, that is, the musical tone of the key-off waveform starts to be generated by key-on. This makes it possible to smoothly control a musical tone from the time of generation to the time of damping without giving unnatural feeling.

Although in the present embodiment, a waveform to be reproduced is switched from a key-on waveform to a key-off waveform during key release (during key-off operation), it is desirable that the waveform-switching position in the key stroke should coincide with a position in which the damper felt touches a string during key release (i.e. a key position in the key stroke during key release in which string vibration starts to be damped) in the case of an acoustic musical instrument.

In an acoustic musical instrument (e.g. grand piano), the above position is typically approximately 4 mm in terms of the key free end position, from the key-returning position (a position in which the key is not operated) when it is assumed that the entire key release stroke is approximately 10 mm and the key-returning position is 0 mm. This value may slightly vary depending upon the tuned condition of the musical instrument. In view of this variation, in the present embodiment, it is preferable that the position in the key stroke in which the waveform to be reproduced is switched from a key-on waveform to a key-off waveform during key release is set to a value within a range of 3 mm to 6 mm from the key-returning position. It goes without saying that a user may suitably change this position in the key stroke as required.

FIGS. 17A to 17D are diagrams useful in explaining an example of applying information of the switch-S3 state defined by a plurality of bits to key-off waveform control when the information is generated, and control methods therefor.

Figure 17A:
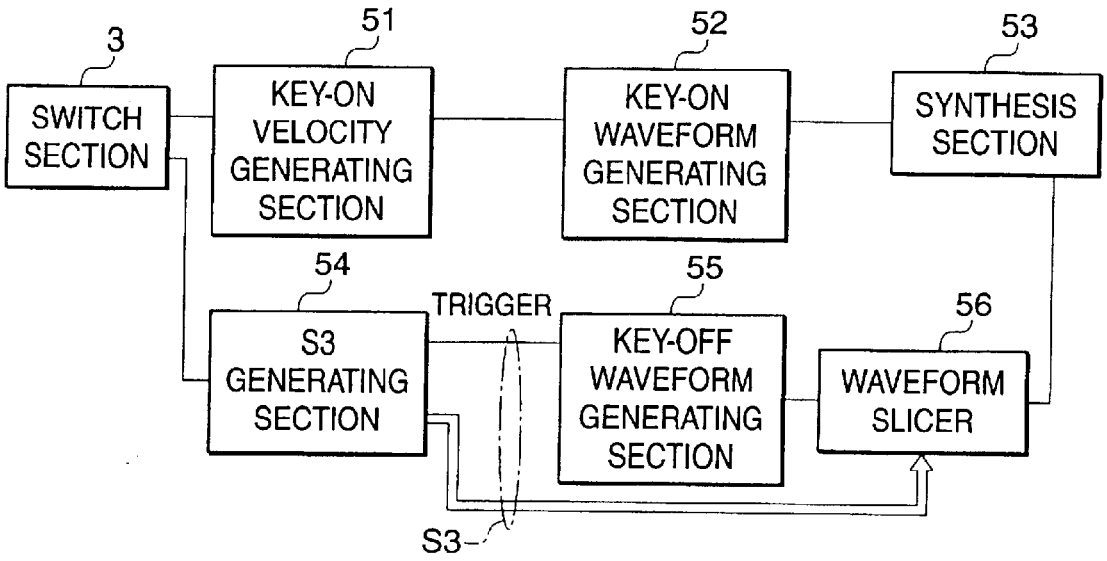
FIG. 17A is a block diagram showing the arrangement of control function blocks of an electronic keyboard musical instrument in which a switch S3 state generated in the form of data of a plurality of bits is applied to a key-off waveform control.

As shown in FIG. 17A, the illustrated apparatus is configured similarly to the electronic keyboard musical instrument according to the present embodiment in that a key-on waveform generated by a key-on waveform generating section 52 according to a key-on velocity generated by a key-on velocity generating section 51, and a key-off waveform generated by a key-off waveform generating section 55 are synthesized by a synthesis section 53, but is distinguished from the same in that a waveform slicer 56 is arranged between the key-off waveform generating section 55 and the synthesis section 53, whereby a degree of chopping carried out by the waveform slicer 56 to slice the key-off waveform generated by the key-off waveform generating section 55, is modified according to the switch-S3 state defined by a plurality of bits generated by a switch-S3 state generating section 54. It should be noted that the switch-S3 state also functions as a trigger signal (information) for generation of a key-off waveform by the key-off waveform generating section 55. For example, one of the plurality of bits of the switch-S3 state may be used as such a trigger signal or a time point the switch-S3 state has switched to a predetermined value may be determined as a time point of triggering the generation of a key-off waveform.

Figure 17B:
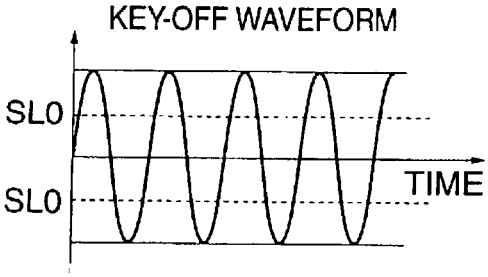
FIG. 17B is a diagram showing an example of a key-off waveform generated by a key-off waveform-generating section appearing in FIG. 17A.
Figure 17C:
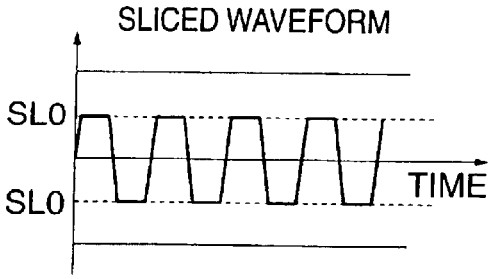
FIG. 17C is a diagram useful in explaining an example of a slicing method for slicing the FIG. 17B key-off waveform by a waveform slicer appearing in FIG. 17A.

For example, when a key-off waveform as shown in FIG. 17B is generated by the key-off waveform generating section 55, the waveform slicer 56 slices the key-off waveform into a sliced waveform as shown in FIG. 17C and outputs the sliced waveform. More specifically, the waveform slicer 56 changes a chopping degree SL0 according to the value of switch-S3 state (formed by a plurality of bits) generated by the switch-S3 state generating section 54, and the input key-off waveform is sliced to this chopping degree SLO and then output. That is, according to the value of the switch-S3 state, the harmonic components of the key-off waveform are increased.

Thus, according to the configuration described above, it is possible to perform, based on the switch-S3 state, the half mute control, that is, control of modifying harmonics to be superposed on the string vibration by changing the degree to which a string touches the damper member during key-releasing operation in the case of the real piano.

Figure 17D:
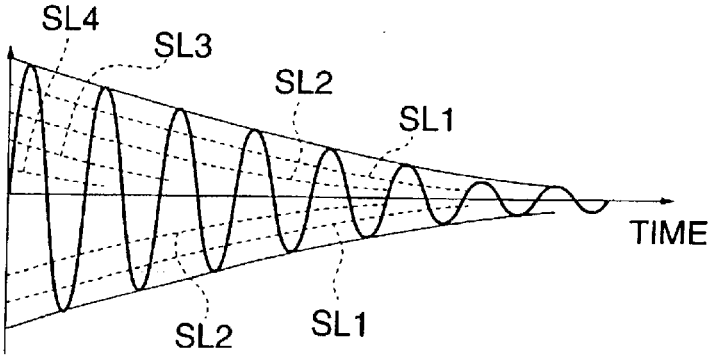
FIG. 17D is a diagram useful in explaining another example of the slicing method different from the FIG. 17 slicing method.

FIG. 17D is a diagram showing another method of slicing the key-off waveform by the waveform slicer 56, in which slicing curves SL1 to SL4 for determining the range of slicing a key-off waveform which is damped with the lapse of time, are also damped with the lapse of time. Further, which of the slicing curves SL1 to SL4 should be selected for use in the slicing process is determined by the value of the switch-S3 state. By the FIG. 17D method as well, the harmonics components of a key-off waveform can be increased according to the value of the switch-S3 state, and hence the half mute control can be carried out.

As described above, by configuring the switch-S3 state by a plurality of bits, and associating the plurality of values (statues) with respective degrees of chopping when the key-off waveform is sliced, the tone color at key-off can be controlled in a multi-stage manner or even in a stageless manner.

What is claimed is:

1. An electronic keyboard musical instrument comprising:

an actuating member;

an output member that is actuated by said actuating member to output a plurality of pieces of information according to respective actuating positions of said actuating member;

a touch information-generating device that generates touch information based on first information output by said output member when said actuating member is in a vicinity of an actuation-terminating position thereof;

a musical tone-generating device that generates a musical tone according to the touch information generated by said touch information-generating device; and a control device responsive to second information output by said output member during returning of said actuating member, said second information being generated on a side closer to an actuation-starting position of said actuating member than a position in which the first information is generated, for providing control such that the musical tone being generated is progressively damped and a musical tone having a predetermined characteristic is generated;

wherein said output member outputs the second information when the actuating position of said actuating member is equivalent to a damper-leaving position in a key stroke of an acoustic piano keyboard.

2. An electronic keyboard musical instrument comprising:

an actuating member;

an output member that is actuated by said actuating member to output a plurality of pieces of information according to respective actuating positions of said actuating member;

a touch information-generating device that generates touch information based on first information output by said output member when said actuating member is in a vicinity of an actuation-terminating position thereof;

a musical tone-generating device that generates a musical tone according to the touch information generated by said touch information-generating device; and a storage device responsive to one of pieces of second information output by said output member during actuation of said actuating member in a key-depressing direction, said pieces of second information being generated on a side closer to an actuation-starting position of said actuating member than a position in which the first information is generated, the one of pieces of the second information corresponding to a key position remotest from a non-key-depression position, for assigning a first value defined by a plurality of bits to a marker indicative of the one of pieces of the second information corresponding to the key position remotest from the non-key-depression position, and storing the assigned first value, said storage device being responsive to another one of the pieces of the second information different from the first information being output by said output member when said actuating member is in a vicinity of an actuation-starting position thereof during returning of said actuating member, the other one of pieces of the second information corresponding to a key position closest to the non-key-depression position, for assigning a second value defined by a plurality of bits to a marker indicative of the other one of pieces of the second information corresponding to the key position closest to the non-key-depression position, and storing the assigned second value; and a parameter control device that controls musical tone parameters based on the stored first and second values.

3. An electronic keyboard musical instrument according to claim 2, wherein said output member has a plurality of contacts, and outputs the information according to respective closing states of the contacts.

4. An electronic keyboard musical instrument according to claim 3, wherein said output member has three contacts.

5. An electronic keyboard musical instrument according to claim 3, wherein said output member has four contacts.

6. An electronic keyboard musical instrument according to claim 2, further comprising a key-off waveform-generating device that generates key-off waveforms.

7. An electronic keyboard musical instrument according to claim 6, further comprising a slicing device that slices a key-off waveform generated by said key-off waveform-generating device.

8. An electronic keyboard musical instrument according to claim 7, wherein said parameter control device controls a level to which said slicing device slices the key-off waveform, based on the stored first or second value.

9. An electronic keyboard musical instrument comprising:

an actuating member;

an output member that is actuated by said actuating member to output information according to an actuating position of said actuating member;

a detection device that detects a touch condition of a key in a second half of a depression stroke thereof in a key-depressing direction, out of a whole key-depression and key-release stroke of the key;

an assigning device responsive to the touch condition of the key being detected by said detecting device, for assigning a musical tone corresponding to the key which is depressed, to a predetermined channel;

a tone-generating device that generates the musical tone assigned to the predetermined channel; and a control device that controls said assigning device such that when a predetermined position in a first half of the depression stroke shallower than the second half of the depression stroke is crossed by the key in a key-releasing direction without the key, to which the musical tone assigned to the predetermined channel corresponds, being re-depressed, the assignment of the musical tone to the predetermined channel is canceled, and when the key, to which the musical tone assigned to the predetermined channel corresponds, is re-depressed without crossing the predetermined position in the key-releasing direction, and a re-touch condition different from the detected touch condition of the key is detected by said detection device upon the re-depression, the musical tone is assigned to a channel different from the predetermined channel according to the re-touch condition of the key.

10. An electronic keyboard musical instrument according to claim 9, wherein said output member has three contacts.

11. An electronic keyboard musical instrument according to claim 9, wherein said output member has three contacts.

12. An electronic keyboard musical instrument according to claim 9, wherein said output member has four contacts.

* * * * *